US005521008A

United States Patent [19]

Lieberman et al.

[11] Patent Number: 5,521,008

[45] Date of Patent: May 28, 1996

[54] MANUFACTURE OF ACTIVATED CARBON FIBER

[75] Inventors: Alexander I. Lieberman; Alexander V. Pimenov; Nicholas Y. Gorokhov, all of St. Petersburg, Russian Federation; Joseph L. Shmidt, Brooklyn, N.Y.; Leonid I. Lieberman, St. Petersburg, Russian Federation

[73] Assignee: Electrophor, Inc., Dobbs Ferry, N.Y.

[21] Appl. No.: 327,542

[22] Filed: Oct. 20, 1994

[30] Foreign Application Priority Data

Nov. 25, 1993 [RU] Russian Federation ..... 93053637

[51] Int. Cl.[6] ..... D02G 3/00

[52] U.S. Cl. ..... 428/367; 428/408; 264/29.2

[58] Field of Search ..... 428/364, 367, 428/408, 447.4, 447.9; 264/29.2

[56] References Cited

U.S. PATENT DOCUMENTS

| | | | |
|---|---|---|---|
| 3,639,140 | 2/1972 | Miyamichi | 423/447.4 |
| 3,639,953 | 2/1972 | Kimura | 264/29.2 |
| 3,661,616 | 5/1972 | Miyamichi | 427/447.9 |
| 3,969,268 | 7/1976 | Fukuda et al. | 423/447 |
| 4,409,125 | 10/1983 | Nishino et al. | 423/447.9 |
| 4,789,509 | 12/1988 | Ikeda et al. | 264/29.2 |
| 4,923,692 | 5/1990 | Nakagoshi et al. | 423/447.4 |

*Primary Examiner*—N. Edwards
*Attorney, Agent, or Firm*—Robert I. Pearlman

[57] ABSTRACT

Activated carbon fiber is made by pre-treating a carbonized fibrous material, preferably a carbonized cellulose fiber, with a solution of nitrogen-containing compound, comprising at least one of the following substances: urea, ammonium carbonate, ammonium bicarbonate, ammonium acetate, and other organic salts of ammonia such as formate, carbamate, citrate and oxylate, and activating the pre-treated carbonized material at 800° to 1200° C. in an atmosphere comprising steam and/or carbon dioxide until a high degree of activation is produced. The activated carbon fiber material is amphoteric, wherein both acidic and basic functional groups are present on its surface. The resulting material is suitable for removing organic impurities, cations and anions from water and other fluids.

3 Claims, 1 Drawing Sheet

MANUFACTURE OF ACTIVATED CARBON FIBER

BACKGROUND OF THE INVENTION

This invention relates to activated carbon fiber with anion-exchange and cation-exchange groups on its surface, and a process for preparing the same. More specifically, it relates to activated carbon fiber obtained by activating carbonized cellulose fiber which has been pretreated with a solution containing urea and/or organic salts of ammonia at an elevated temperature in an atmosphere containing steam and/or carbon dioxide. The thus obtained activated carbon fibers have anion-exchange and complex forming groups on its surface and are especially suitable for removing organic and inorganic impurities from fluids.

Activated carbon fibers (referred to hereafter as ACF) are manufactured by activating carbonized fiber at an elevated temperature in an activating gas atmosphere, typically steam and/or carbon dioxide and/or ammonia. Carbonized fibers are made by carbonizing polyacrylonitrile, phenol resin, pitch or cellulose fibers in an inert atmosphere. In conventional carbonization, the organic material is heated to 200° to 800° C., typically over 400° C. for sufficient time to remove low molecular weight organics and tars leaving more than 90% carbon, typically in the form of crystalline-amorphous structures (graphite layers) rather than a porous structure. Use of steam or $CO_2$ is avoided to retain the carbon fiber strength. Pretreatment steps prior to carbonization are known in the art.

Processes for producing fibrous activated carbon have been known for many years wherein fibrous organic materials are first carbonized in an inert atmosphere to remove volatile materials, and then activated to form the desired porous active surface in the carbonized fiber. Activated carbon fibers are very small in diameter, typically 5 to 30 microns. Very small fiber diameter provides high adsorption capacity and rate of adsorption. At the same time, very small fiber diameter makes it more difficult for carbon fiber to retain its integrity after activation (over-activated carbon fiber may easily turn into powder). In order to improve the flexibility of carbonized fibers, U.S. Pat. No. 4,409,125, teaches performing the carbonization process in the presence of ammonium chloride, nitric acid or boric acid. The carbonized fiber is then activated with zinc chloride.

ACF main advantages over powdered activated carbon are higher adsorption capacity, higher speed of adsorption and lesser compaction under flow. One of the disadvantages of powdered activated carbon is that it compacts during filtration (compaction under flow) leading to a sharply increased flow resistance. Powdered activated carbon can be bound into a porous rigid matrix, which reduces flow resistance, but it also limits the adsorption capacity.

Activated carbon fiber may be used for removing impurities either from gas or water.

A preferred adsorbent for tap water purification should have high adsorption capacity and high adsorption rate toward organic impurities, anions and cations. It should also be strong and flexible, so that it does not break down into the powder or compact significantly under water flow. It should also be inexpensive to produce. The present invention meets these needs.

BRIEF DESCRIPTION OF THE INVENTION

An object of this invention is to provide a novel activated carbon fiber adsorbent and a process for preparing the same from a carbon fiber material.

The present invention provides a novel activated carbon fiber adsorbent which is highly efficient in removing harmful organic substances, cations and anions from water, and a process for preparing same.

The activated carbon fiber adsorbent of the present invention is inexpensive and strong so as to resist powdering and compaction. The present process prepares same from carbonized fiber with an increased yield of activated carbon fiber adsorbent and a reduced amount of carbonized fiber burn-off during activation.

The activated carbon fiber of this invention can be obtained by pretreating carbonized fiber with a solution containing urea and/or ammonium carbonate, bicarbonate; and acetate or other organic salts of ammonia such as ammonium formate, carbamate, citrate (dibasic) and oxylate monohydrate, preferably at 1–2% by weight. The pretreated carbonized fiber is then activated at an elevated temperature in the presence of activating gas, which produces a highly porous activated carbon fiber with open pores on its surface and an increased quantity of anion and cation groups on its surface.

DETAILED DESCRIPTION OF THE INVENTION

Figure 1:
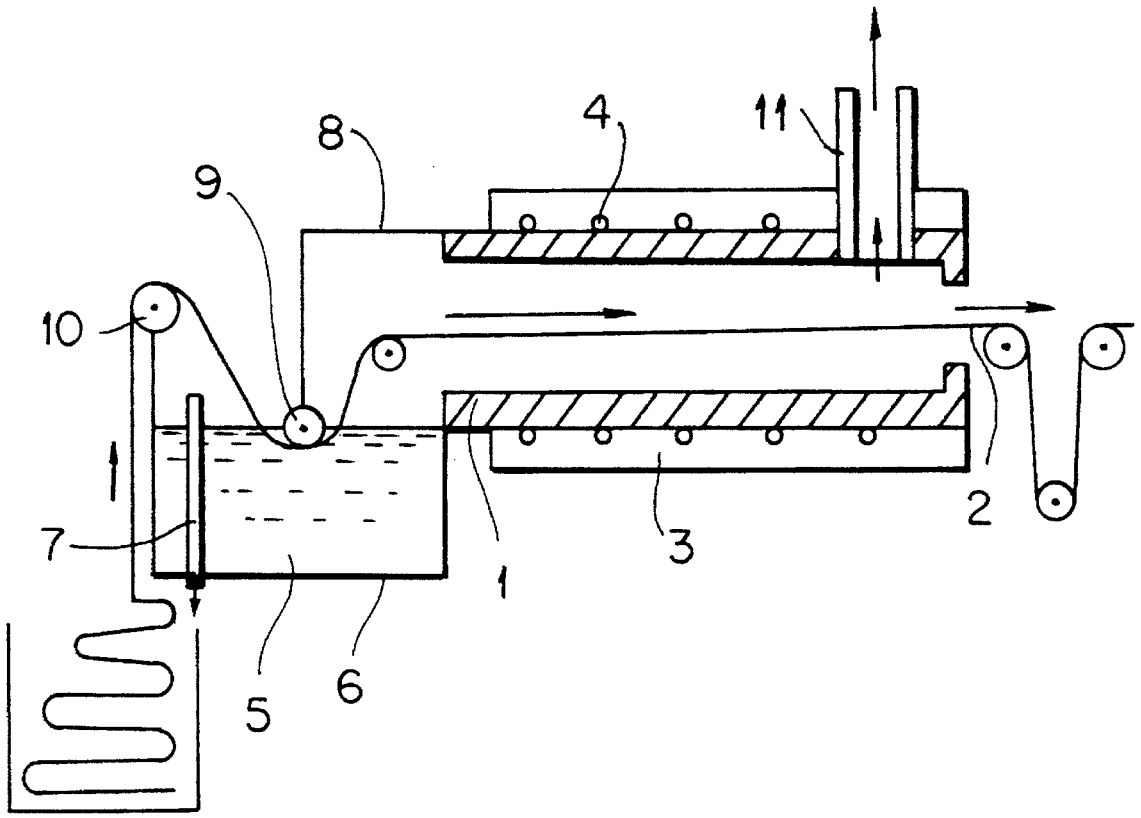

Various conventional fibrous carbonized carbon can be used as the precursor material for making activated carbon of the present invention.

According the present invention there is provided a method of preparing a fibrous activated carbon including the steps of activating carbon fiber at temperatures between 800° C. to 1200° C. in an active atmosphere comprising steam and/or carbon dioxide, wherein prior to activation the fiber is impregnated with an impregnating material comprising one or more compounds in the form of organic salts of ammonia; urea or other nitrogen containing compounds set forth below, preferably in the form of organic salts.

The diameter of the carbon fiber which is used as a precursor material can vary, typically, from 1 to 30 microns. Smaller diameter fibers are more flexible and provide more surface area, but the duration and temperature of activation of smaller diameter carbon fiber has to be monitored very carefully because very small over-activated carbon fiber has very little tensile strength and may readily turn into powder. Investigation of diffusion of a cyclical organic compound, such as methylene blue, into the activated carbon fiber indicates that activated carbon fiber which is 6 microns in diameter can adsorb up to 80% of its full adsorption capacity within 3 minutes from the beginning of the adsorption process. The preferred diameter of the activated carbon fiber is from 1 to 10 microns, typically 4 to 8 microns. This represents a good compromise between the surface area, ease of activation and further use and processing.

The fiber can be, for example, in a form of tow, felt, yarn, non-woven cloth or fabric.

The impregnating material is impregnated onto the fiber before activation commences.

The impregnating material may consist of one or a mixture of two or more nitrogen containing compounds. Organic compounds are preferred, in part, due to the ease of their decomposition at the activation temperature, and, also, because the byproducts of activation are easier to treat and discard afterward. Activation of carbon fiber produces waste gases, mainly organic in nature. Said waste gases are taken from the activation reactor through a suitable gas treatment unit, i.e., catalytic high temperature converter, to the outside. One advantage of using organic additives is that the same catalytic converter can be used to treat all effluent.

The impregnating material is, preferably, at least one of the following compounds: urea, ammonium carbonate or bicarbonate, ammonium acetate or other organic salts of ammonia, such as ammonium formate, carbamate, citrate and oxalate. The impregnating material is preferably impregnated onto the carbon fiber by immersing the carbon fiber into the impregnating solution. The impregnating solution is 0.1% to 20% weight/weight solution and preferably 1% to 2% weight solution. Different solvents can be used, such as water, lower alcohols such as ethyl or methyl alcohol. Water is the preferred solvent.

The fiber is preferably carbonized at 800° C. to 1200° C., and especially, 900° to 1150° C. The activation atmosphere will usually contain one or more of the following carbon dioxide, steam, ammonia, hydrogen, or combustion gases from hydrocarbon fluids.

Activation times are from 1 to 20, preferably 2 to 10, minutes.

Activated carbon fiber prepared from carbon fiber impregnated with nitrogen containing compounds in accordance with the present invention are generally found to have higher anion-exchange capacity, higher cation-exchange capacity and higher adsorption capacity toward organic substances. Furthermore, it has been found that the presence of the nitrogen containing compounds in the impregnating solution increases the yield of the activated carbon fiber production, thus making possible greater amounts of activated carbon fiber from the same weight of the carbon fiber precursor material.

The preparation of activated carbon fiber in accordance with the present invention and the resultant product will be described by way of the following examples and drawings.

DRAWINGS

FIG. 1 shows a cross sectional view of the apparatus for continuous activation of the carbon fiber material.

In the following examples carbon fiber in a form of a continuous tow was activated by passing it through the activation reactor as it is described below.

The apparatus for continuous activation of carbon fiber as shown in FIG. 1 comprises the activation chamber, means for feeding carbon fiber into the activation chamber, means for removing activated fiber from the activation chamber and means for treating (impregnating) fiber material with the additive solution.

Said treatment means can be, for example, in the form of a reservoir for the additive solution, which is located at the side of the activation chamber which also has the means for feeding carbon fiber into the activating chamber. The reservoir connects to the activation chamber. The reservoir for the additives solution comprises additional means for regulating the level of the additive solution, which is may, for example, be in a form of an overflow pipe. The activation chamber of the apparatus has a cylindrical form, comprising an appropriate means for continuous activation of tow materials. A partition is attached to the activation chamber from the side of the material inlet. One edge of the partition is attached hermetically to the upper part of the activation chamber above the area where carbonized material enters the activation chamber. Another edge of the partition is immersed into the reservoir for the additive solution. A suitable roller may be attached to the edge of the partition immersed into the reservoir for changing the direction of movement of the fiber tow.

The apparatus of FIG. 1 for continuous activation of carbon fiber comprises the activation chamber 1, fiber material 2, which is being transported inside the activation chamber. The activation chamber 1 is placed inside housing 3, and it is supplied with heating means, for example, electrical heating element 4. Means for treating (impregnating) carbon fiber with the additive solution 5 is placed at the entrance into the activation chamber. Said means for impregnating is made, for example, as a reservoir 6 connected with the activation chamber. The reservoir for the additive solution 6 additionally comprises means for regulating the level of the additive solution in a form of an overflow pipe 7.

An additional means for changing the direction of material movement in the reservoir 6 in a form of a roller 9 is attached to the edge of the partition 8. Carbon fiber movement through the activation chamber is achieved with rollers 10. Pipe 11 is for removing effluent gases which are created during activation. Effluent gases can be converted into the carbon dioxide, water and nitrogen dioxide with a suitable catalytic converter, not shown.

The apparatus works in the following way:

Initial fiber material is transported into the impregnation solution 5 by the transport means 9 and 10. After passing through impregnation chamber, soaked carbon fiber moves into the activation chamber 1. At the exit from the activation chamber 1, activated carbon fiber is cooled in the air as it travels around the additional rollers.

Material of the invention is produced by the method of the invention in the following manner:

Initial carbon fiber, preferably cellulosic, was produced by carbonizing polymer fibers in the customary manner (heat treated at elevated temperatures). The carbonized fiber is then impregnated with the additive water solution. Impregnated fiber is activated at temperature of 800°–1200° C. for 1 to 20 minutes and then it is cooled with air. Particularly preferred conditions are 900° to 1150° C. for 2 to 10 minutes.

Produced activated carbon fiber is analyzed for its adsorption activity with methylene blue. It is also analyzed for the content of acidic and basic functional groups by measuring its static exchange capacity (referred to as SEC).

The adsorption capacity of the activated carbon fiber was measured as a function of its adsorbability of methylene blue. Methylene blue adsorption capacity of activated carbon fiber was determined by taking a 500 ml flask containing 200 ml of 1500 mg/L solution methylene blue and 100 mg of ACF and shaking it for 24 hours. All methylene blue concentration measurements were done by first filtering the solution through a polyester filter and then measuring light absorbance at 622 nm.

Cation-exchange capacity of ACF was determined by taking 250 ml flask containing 100 ml of 0.1M NaOH in 1M NaCl solution and 1 gram of ACF and shaking it for 24 hours. Then the solution was filtered through filter paper and titrated with 0.1M HCl to determine the amount of base neutralized by acidic groups of ACF. Anion-exchange capacity of ACF was determined in the same manner, but hydrochloric acid solution was used instead of sodium hydroxide solution.

The above procedures were used in the examples set forth below.

The activated carbon fibers of the present invention have the following characteristics:

| Static Exchange Capacity (meq/gm) | Broad Ranges | Preferred Ranges |
|---|---|---|
| acidic functional groups | not less than 0.3 | not less than 0.4 |
| basic functional groups | not less than 0.2 | not less than 0.25 |
| Adsorptive Capacity (meq/gm) (methylene blue) | not less than 350 | not less than 400 |
| Carbon fiber, diameter in microns | 1.0 to 30.0 | 4 to 8 |

As illustrated by the following examples, the present invention produces a new material with significantly improved adsorption properties as well as significant improved mechanical strength (resistance to breakage). This is achieved by a relatively low degree of material burn off during activation. In addition, this new activated carbon fiber has a unique combination of properties allowing it to adsorb simultaneously different types of compounds. It is amphoteric. The present method for producing activated carbon fiber is distinctive in forming significant quantities of both basic and acidic groups on the carbon material surface.

The following examples will serve to illustrate the present invention. Unless otherwise indicated, all part and percentages in the specification are by weight.

The carbonized fiber which was used in the Examples below was purchased from Kuibishev Fiber Corporation (White Russian Republic). It was made by immersing rayon fiber into a solution of silicon-carbohydrate surfactant in carbon tetrachloride, removing the excess solution, and carbonizing the treated rayon fiber at 150° to 350° C. and then at 400° to 800° C. for a total of 72 hours.

The heat treatment step in each of Examples 1 to 13 was conducted for 3.5 minutes (100 cm long reactor with a speed of 28 cm/min.). The heating temperature was 1000° C. in Examples 1 to 9. The temperature was varied as indicated in Examples 10 to 13.

EXAMPLES 1 AND 2 (Comparative Control)

Two samples of the above carbon fiber precursor were soaked in water and treated with steam at 1000° C. with a corresponding weight loss of 38% and 50%. Produced activated carbon fiber samples were analyzed for adsorption capacity and SEC values (see Table 1).

EXAMPLE 3

Carbon fiber precursor was soaked in 1% ammonium acetate solution and activated at 1000° C. Produced activated carbon fiber samples were analyzed (see Table 1).

EXAMPLES 4 TO 6

The experimental conditions of Example 3 were repeated, except that the impregnating solution for the activation step was changed to 0.5%, 1% and 2% urea solution, respectively. The same carbonization and activation conditions were employed as in Example 3. Results of analyzing the resultant ACF product are shown in Table 1.

EXAMPLES 7 TO 9

The conditions of Examples 4 to 6 were repeated, except the impregnating solution was changed to 0.2%, 1% and 3% of ammonia bicarbonate solution. Product characteristics are shown in Table 1.

EXAMPLES 10 TO 13

The conditions of Examples 4 to 6 were repeated except the impregnating solution was changed to 0.5% ammonia acetate solution and the activation temperature varied to 750°, 950°, 1100° and 1250° C. in Examples 10 to 13, respectively. Product characteristics are shown in Table 1.

TABLE 1

| Example No. | Weight Loss % | Additive Wt % | Adsorption Capacity Methylene Blue mg/gm | SEC Acidic Groups meq/gm | SEC Basic Groups meg/gm |
|---|---|---|---|---|---|
| 1 | 38 | 0 | 300 | 0.40 | 0.20 |
| 2 | 50 | 0 | 350 | 0.40 | 0.15 |
| 3 | 37 | 1.0 | 510 | 0.50 | 0.50 |
| 4 | 37 | 0.5 | 500 | 0.61 | 0.45 |
| 5 | 39 | 1.0 | 510 | 0.56 | 0.45 |
| 6 | 35 | 2.0 | 350 | 0.59 | 0.45 |
| 7 | 38 | 0.2 | 350 | 1.03 | 0.47 |
| 8 | 40 | 1.0 | 420 | 1.28 | 0.48 |
| 9 | 44 | 2.0 | 370 | 1.08 | 0.51 |
| 10 | 25 | 0.5 | 260 | 0.15 | 0.15 |
| 11 | 38 | 0.5 | 430 | 0.50 | 0.40 |
| 12 | 40 | 0.5 | 450 | 0.55 | 0.50 |
| 13 | 48 | 0.5 | 370 | 0.75 | 0.51 |

Analysis of the Examples 1–13 shows that using the present additives during activation not only makes the resultant activated carbon fiber amphoteric but also leads to a significant increase in its adsorption capacity at relatively limited degrees of material burn off.

Additional experiments with additive concentrations of 0.2 wt % and below show an insufficient positive influence on the carbon fiber properties. Concentrations of 2% to 20% have been found to lead to reduced adsorption characteristics, probably due to burning-out of the mezo- and macropores of the carbon fiber when there is a large concentration of gaseous additive decomposition products in the reactor. Therefore, best technical results pursuant to the present process are achieved with 1 to 2 wt. % additive solutions.

The activated carbon fiber material of the present invention can be used for purifying liquid media from unwanted additives, such as for example purifying tap water, and for water preparation in industrial and pharmaceutical applications. It can also remove unwanted additives from gaseous media. It is capable of removing up to 99.5% of phenol, 96% of oil products, 98% of pesticides, and 99% of heavy metal ions from drinking water.

What is claimed is:

1. Activated carbon fiber made from carbonized polymer fibers which has on its surface significant quantities of both acidic and basic functional groups and thus is amphoteric, wherein the quantity of acidic functional groups is characterized by a static exchange capacity (SEC) of not less than 0.40 meq/gm and wherein the quantity of basic functional groups is characterized by a static exchange capacity (SEC) of not less than 0.25 meq/gm, thereby allowing it to absorb various types of compounds.

2. The activated carbon fiber of claim 1 wherein the carbon fiber's adsorption capacity is characterized by an adsorbability of methylene blue of not less than 350 mg/gm.

3. The activated carbon fiber of claim 1 which is produced mainly from carbonized and activated cellulose containing fibers and wherein the carbon fibers are 1.0–30.0 micron in diameter.

* * * * *